US006862831B1

(12) United States Patent
Canaday

(10) Patent No.: US 6,862,831 B1
(45) Date of Patent: Mar. 8, 2005

(54) FIREARM BREECH SAFETY LOCK

(75) Inventor: Benjamin J. Canaday, Paducah, KY (US)

(73) Assignees: Benjamin Canaday, Kevil, KY (US); Clay Elrod, Smithland, KY (US); David Elrod, Boaz, KY (US)

( * ) Notice: Subject to any disclaimer, the term of this patent is extended or adjusted under 35 U.S.C. 154(b) by 0 days.

(21) Appl. No.: 10/678,697

(22) Filed: Oct. 3, 2003

(51) Int. Cl.[7] ..... F41A 17/00

(52) U.S. Cl. ..... 42/70.11; 42/70.07; 42/66; 42/70.01

(58) Field of Search ..... 42/70.01, 70.06, 42/70.11, 66, 70.07; D22/108

(56) References Cited

U.S. PATENT DOCUMENTS

| | | | | |
|---|---|---|---|---|
| 2,327,334 A | * | 8/1943 | Parker | 42/70.11 |
| 2,887,807 A | * | 5/1959 | Santangelo | 42/70.11 |
| 3,022,598 A | | 2/1962 | Wikstrom | |
| 3,027,674 A | * | 4/1962 | Mahan | 42/70.11 |
| 4,224,753 A | | 9/1980 | Bielman | |
| 4,512,099 A | | 4/1985 | Mathew | |
| 4,783,924 A | | 11/1988 | Thurber | |
| 5,038,508 A | * | 8/1991 | Brown | 42/70.11 |
| 5,042,185 A | | 8/1991 | Justice, Sr. | |
| 5,048,211 A | | 9/1991 | Hepp | |
| 5,070,635 A | * | 12/1991 | Cvetanovich | 42/70.11 |
| 5,179,234 A | | 1/1993 | Cvetanovich | |
| 5,289,653 A | | 3/1994 | Szebeni et al. | |
| 5,315,778 A | | 5/1994 | Wolford | |
| 5,357,704 A | | 10/1994 | Benkovic | |
| 5,475,994 A | | 12/1995 | Briley, Jr. et al. | |
| 5,491,918 A | | 2/1996 | Elmstedt | |
| 5,664,358 A | | 9/1997 | Haber et al. | |
| 5,699,687 A | | 12/1997 | Pittman | |
| 5,860,241 A | | 1/1999 | Waters | |
| 5,918,403 A | | 7/1999 | Lurz, Jr. et al. | |
| 5,950,344 A | | 9/1999 | Ross | |

(List continued on next page.)

FOREIGN PATENT DOCUMENTS

| | | |
|---|---|---|
| FR | 265581 | 2/1990 |
| GB | 2158924 | 11/1985 |

OTHER PUBLICATIONS

International Patent Application PCT/AU91/00465 by Benkovic for the "Firearm Lock" published on Apr. 16, 1992.

*Primary Examiner*—Michael Carone
*Assistant Examiner*—Lulit Semunegus
(74) *Attorney, Agent, or Firm*—Carrithers Law Office PLLC; David W. Carrithers

(57) ABSTRACT

A safety device for preventing unauthorized or accidental use of a gun. The safety device includes a solid body of material, a muzzle end plug and an elongate threaded rod inter-connecting the same. The solid body is sized and shaped to simulate a live cartridge. It has an outwardly directed flange at one end for engaging an end wall surrounding entry into the cartridge chamber of the gun and a threaded bore extending inwardly a selected distance from the opposite end. An O-ring fits into a groove it the solid body and projects outwardly frictionally to engage the inner wall surface-of the gun barrel in the cartridge chamber. The muzzle plug has an outwardly directed flange at one end thereof that engages an outer end of the gun barrel. The muzzle plug has a recess in the outer end face remote from the elongate rod and in a preferred embodiment beyond the recess there is chamfered surface tapering to the extent that the outwardly directed flange has a thin narrow edge that cannot be gripped by pliers or the like. A key has a projection that mates with the recess in the muzzle plug. A pin projects from the key projection and fits into a small recess in the base of the first mentioned plug recess.

2 Claims, 2 Drawing Sheets

U.S. PATENT DOCUMENTS 6,223,566 B1 * 5/2001 Jamison
6,311,422 B1 11/2001 Exum et al.
6,374,527 B1 * 4/2002 Finardi ..... 42/70.11
6,405,470 B1 6/2002 Strahan
6,405,472 B1 6/2002 Dojcsak
6,408,556 B1 6/2002 Achee et al.
6,418,654 B1 7/2002 Trois et al.
6,526,684 B1 3/2003 Hickerson
6,530,168 B2 3/2003 Shimi et al.
6,560,910 B1 5/2003 McLaren
6,578,308 B2 6/2003 Hickerson
6,604,313 B1 * 8/2003 Kress ..... 42/70.11
D482,424 S * 11/2003 Barber et al. ..... D22/108
6,701,655 B2 * 3/2004 Milo ..... 42/70.11
2001/0034961 A1 11/2001 Hickerson
2002/0059746 A1 5/2002 Ross et al.
2002/0121039 A1 9/2002 Kellerman
2002/0189148 A1 12/2002 Hanagun

* cited by examiner

FIREARM BREECH SAFETY LOCK

BACKGROUND OF THE INVENTION

Technical Field

The present invention relates generally to a firearm breech safety device to prevent unauthorized or accidental discharge of he firearm.

BACKGROUND OF THE INVENTION

Firearm safety devices are known and by way of example reference maybe had to U.S. Pat. No. 4,224,753 granted Sep. 30, 1980 to T. F. Bielman. This patent is closely related to the present invention and is the most pertinent reference known to the applicant. The substance of the foregoing patent is incorporated herein by reference thereto.

The Bielman patent teaches a safety device which includes a dummy cartridge that fits into the chamber of the barrel and is connected to a barrel end plug or muzzle cap by a threaded elongate rod. A hand tool is used to un-thread the rod from the dummy cartridge permitting removal of the muzzle cap and rod. Nothing is provided by the patentee that prevents the dummy cartridge from rotating in the chamber when the hand tool is used to un-thread the rod and in some instances this can make the task difficult and perhaps even impossible.

The dummy cartridge of the patented safety device is constructed from an empty shell that has an insert connected to the rear wall of the shell by a shaft anchored in the rear wall. The construction is complicated and therefore relatively expensive to produce as compared to the instant invention. Furthermore no means is provided to protect the gun chamber from the insert and damage thereto that possibly can occur through repeated use of the same.

SUMMARY OF INVENTION

In keeping with the foregoing there is provided in accordance with the present invention there is provided in accordance with the present invention a gun safety device for preventing unauthorized or accidental use of the same comprising a solid body of material sized to fit into the cartridge chamber of a selected gun. The solid body has an outwardly directed flange at one end thereof for engaging an end wall surrounding entry into the cartridge chamber and a threaded bore extending inwardly a selected distance from and end of the body opposite the one end. Means on the body projects outwardly therefrom frictionally to engage a wall of the cartridge chamber surrounding the solid body. A muzzle plug insertable into an open outer end of the barrel of the gun has an outwardly directed flange at one end that is engagable with an outer end of the gun barrel. An elongate rod threaded along at least a portion at one end for threading into the threaded bore in the solid body and includes means connecting the opposite end of the rod to the muzzle plug.

A principal object of the present invention is to provide an improved safety device by having means on the dummy cartridge that resists rotation of the dummy device in the chamber when turning the threaded rod during installing or uninstalling the device.

A further object is to provide a dummy cartridge that has a cushioned contact with the walls of the magazine.

A still further object is to provide a firearm safety device with a simple one piece dummy cartridge that has a threaded bore extending therein from one end thereof.

A still further object is to provide a firearm safety device with a simple one piece dummy cartridge with a threaded bore in one end thereof and an enlarged entry gradually decreasing in size in direction toward the threaded portion and thereby providing means to direct and guide the end of the elongate threaded rod toward the threads.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

Figure 1:
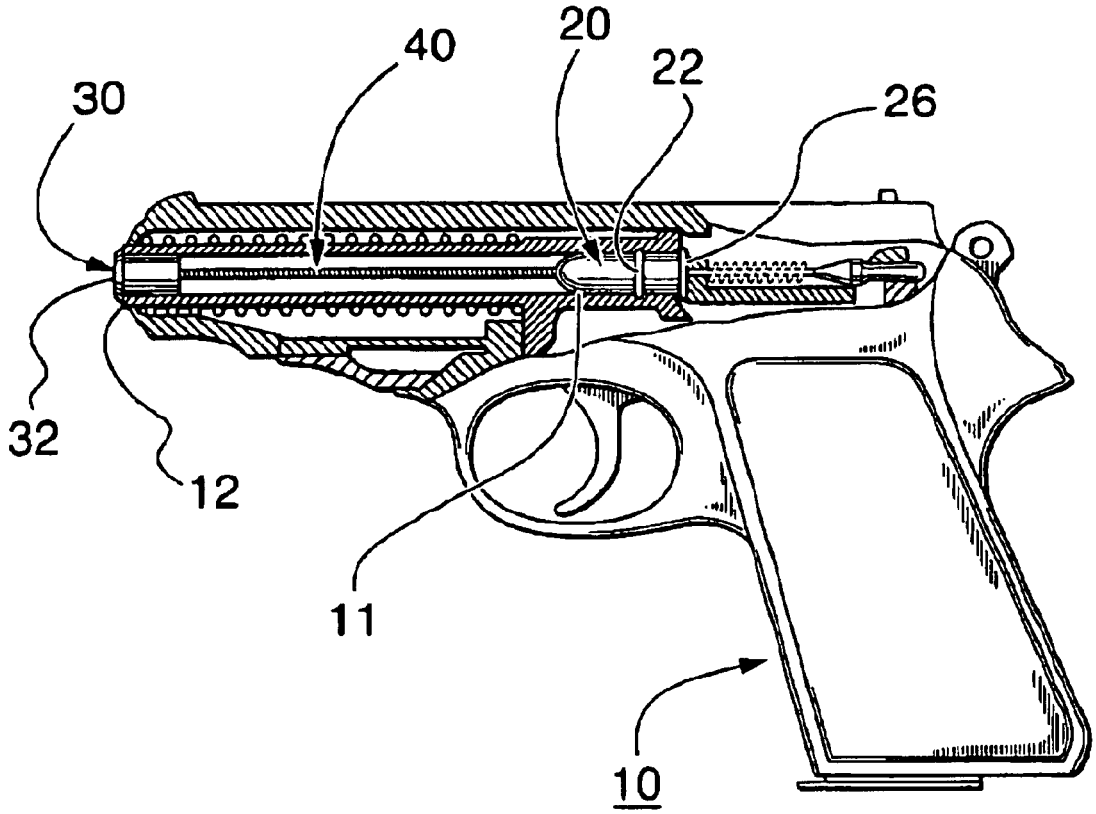
FIG. 1 is a partial sectional view of a hand gun having a safety device provided in accordance with the present invention installed therein.
Figure 2:
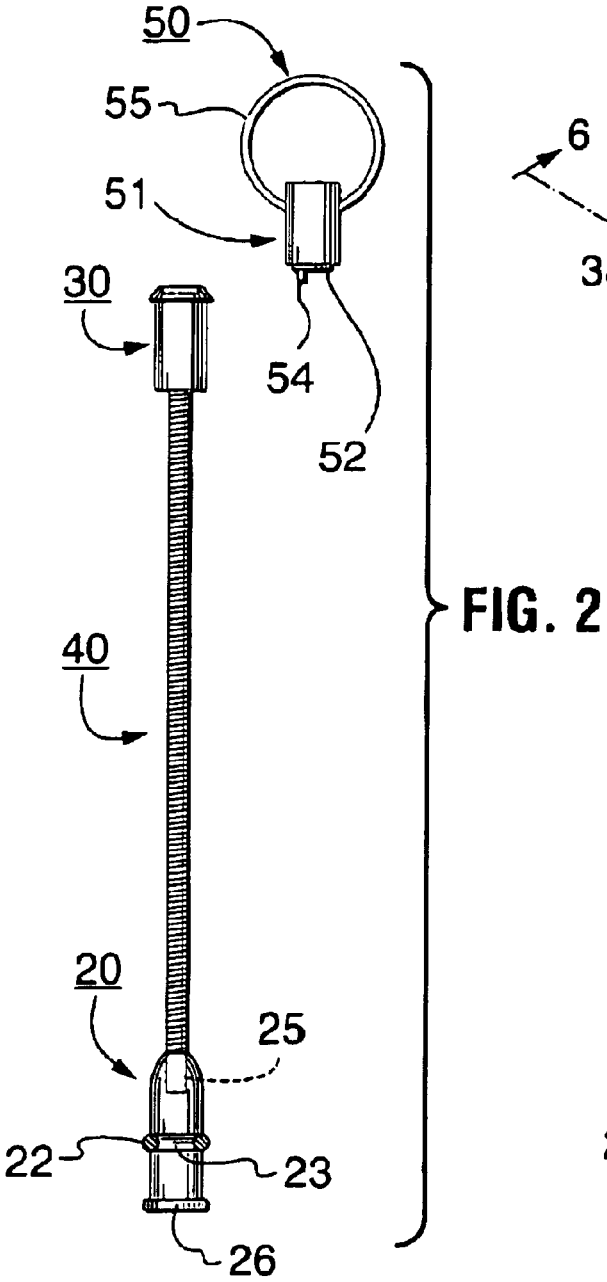
FIG. 2 is an exploded view illustrating the components of the safety device including a key for installing and un-installing the device.
Figure 3:
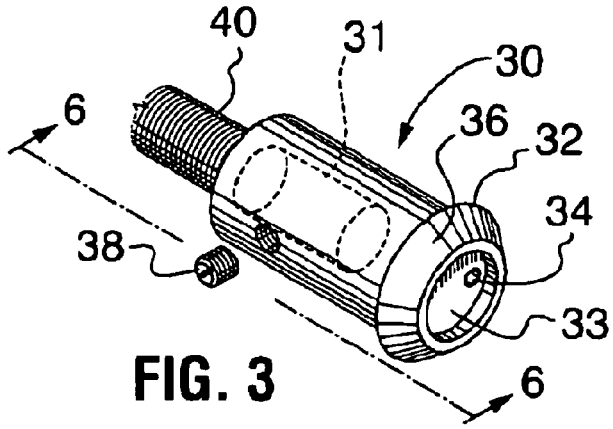
FIG. 3 is an oblique view of the muzzle plug end portion of the safety device.

Referring to the drawings, FIG. 1 illustrates a partial side sectional view of a hand gun 10 having a safety device of the present invention installed therein to prevent unauthorized use or accidental discharge of the gun. The safety device consists of a dummy cartridge 20, a muzzle end plug 30, and an elongate threaded rod 40 inter-connecting the two. A key 5 as best shown in FIG. 2 is provided for installing and un-installing the device.

Figure 5:
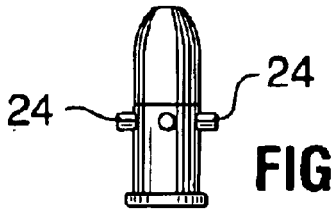
FIG. 5 is an oblique view of a dummy cartridge wherein the o-ring shown in FIG. 2 is replaced by pins of resilient material seated in recesses and radiating outwardly from the outer surface of the dummy cartridge.
Figure 6:
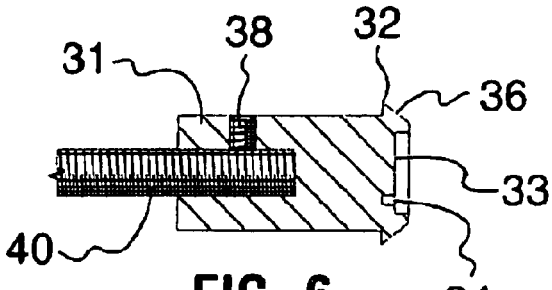
FIG. 6 is a sectional view taken essentially along line 6—6 of FIG. 3.

The dummy cartridge is a solid body of metal such as aluminum steel, copper, or preferably brass, or other suitable material such as nylon, fiber glass, wood, rubber, TEFLON, carbon composite material, polymeric material, or even paper composite. The dummy cartridge is shaped to generally conform with that of a live cartridge designed to be used with the particular firearm at hand, or which duplicates the size, shape and dimensions of a live cartridge commercially available. Of course, the dummy cartridge differs from the live cartridge in that the instant invention includes means on the outer surface thereof that resiliently and frictionally engages the walls of the magazine 11 of the gun. In the preferred embodiment such means consists of an O-ring 22 of resilient material seated in an annular groove 23 in the outer surface of the dummy cartridge. An alternative to this is illustrated in FIG. 5 in which the O-ring is replaced by resilient pins 24 radiating outwardly from the outer surface of the dummy cartridge. The pins for example maybe three or more in number, preferably equal spaced about the periphery, and each attached by suitable means such as by a suitable adhesive or by being seated in a recess in the body of the dummy cartridge. The means for frictionally engaging the sidewalls of the bore or magazine resists rotation of the dummy device in the chamber when turning the threaded rod during installing or uninstalling the device. Moreover, the means for frictionally engaging provides a way of identifying the dummy cartridge as such and not a live round, for the pins or O-ring is identifiable by feel and look which is different from that of a live round. Of course, it is contemplated that the cartridge and O-ring of the instant invention could be fabricated from the same material and/or could even be a molded one piece construction, such as a hard rubber bullet.

Figure 4:
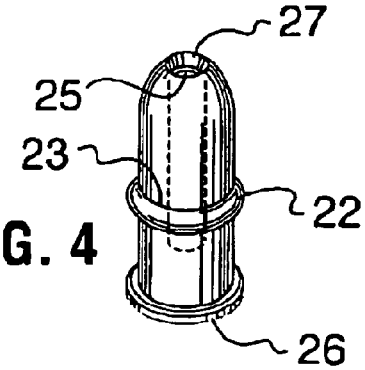
FIG. 4 is an oblique view of an end portion of a dummy cartridge having a concave entry area leading into the threaded bore.

The dummy cartridge has a threaded bore 25 extending inwardly from one end thereof and at the opposite end there is an annual outwardly projecting rib 26 that engages the end wall of the magazine. As best illustrated in FIG. 4, a conical portion 27 tapers toward the threaded portion of the bore and provides means to direct and guide the free end of the elongated rod toward the threaded portion of the threaded bore.

The muzzle end plug 30 is a solid cylindrical body of material such as brass (or other suitable material) having a threaded bore 31 extending inwardly from one end thereof and at the opposite end there is an annular outwardly projecting rib 32 surrounding a circular recess 33. The recess is preferably co-axial with the cylindrical body and has a further substantially smaller pin receiving hole or recess 34 therein that is off-set from the axis of the recess 33. The rib 32 engages the the outer end 12 the muzzle 13. The rib 32 has a tapered outer face 36 located outside of the gun barrel. The taper is such that the outer peripheral edge of the rib is a narrow edge that cannot be gripped by pliers, locking pliers known under the trademark VISE-GRIP or the like thereby preventing unauthorized removal of the device.

The elongate rod is threaded into the threaded bore 31 and is anchored by suitable means such as a set screw 38 or jam nut (not shown) or a substance applied to the threads such as for example a product sold under the trademark LOCK-TITE.

A key 50 comprises a body 51 of brass, or other suitable material preferably comprised of metal or plastic, that has at least an end portion 52 that is cylindrical and of such diameter as to project into the recess 33 in close fit relation therewith. Of course it is contemplated that other geometric shapes could be utilized as long as cooperative engagement of the two portions was possible. In the embodiment shown, the portion 52 has a length corresponding approximately to the depth of the recess 33 and by way of example maybe 80 thousandths of an inch. A pin 54 projects from the end of the body portion 52 and is positioned to project into the recess 34 when the end portion 52 is located in the recess 33. The pin for example maybe a hardened steel roll pin and is offset the same amount as the pin receiving hole 34. Means are provided to rotate the end plug 30 about it's longitudinal axis. A split ring 55 passes through an aperture through the body 51 and provides means for attaching the key to a key chain, ring or the like.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A gun safety device for preventing unauthorized or accidental use of the same comprising:

a solid body of material sized to fit into a cartridge chamber of a selected gun, said solid body having an outwardly directed flange at one end thereof for engaging an end wall surrounding entry into said cartridge chamber and a threaded bore extending inwardly a selected distance from an end of said body opposite said one end, resilient means on said body defining an o-ring that projects outwardly therefrom frictionally engaging a wall of said cartridge chamber surrounding said solid body, said solid body including an annular groove extending about the periphery of said body and wherein said O-ring fits into said groove said O-ring resisting rotation of said solid body in the cartridge chamber when rotating an elongated threaded rod during installing or removing said solid body and a muzzle plug;

said muzzle plug insertable into an open outer end of the barrel of the gun, said muzzle plug having an outwardly directed flange at one end thereof that is engagable with an outer end of said gun barrel, said flange having an annular outwardly projecting rib having a tapered outer end face portion surrounding a first recess in said plug creating a chamfered edge;

said muzzle plug having an outer end face at said one end thereof;

said muzzle plug having a longitudinal axis, wherein said first recess is circular forming a wall concentric with said axis;

said outer end face includes said first recess for receiving a body of a key and a second pin receiving recess located in said first recess offset from a longitudinal axis of the said plug;

said elongate rod being threaded along at least a portion at opposing ends thereof for threading into said threaded bore in said solid body and for threading into a threaded bore of said muzzle plug for connecting said solid body to said muzzle plug; and said key having an end portion projecting therefrom sized and shaped for close mating fit relation in said first recess and a second projection defining a pin for mating with said second pin receiving recess.

2. A gun safety device for preventing unauthorized or accidental use of the same comprising:

a solid body of material sized to fit into a cartridge chamber of a selected gun, said solid body having an outwardly directed flange at one end thereof for engaging an end wall surrounding entry into said cartridge chamber and a threaded bore extending inwardly a selected distance from an end of said body opposite said one end, holding means on said solid body defining at least one resilient pin radiating outwardly from an outer surface of said solid body frictionally engaging a wall of said cartridge chamber surrounding said solid body;

a muzzle plug insertable into an open outer end of the barrel of the gun, said muzzle plug having an outwardly directed flange at one end thereof that is engagable with an outer end of said gun barrel, said flange having an annular outwardly projecting rib having a tapered outer end face portion surrounding a first recess in said plug creating a chamfered edge;

said muzzle plug having an outer end face at said one end thereof;

said muzzle plug having a longitudinal axis, wherein said first recess is circular forming a wall concentric with said axis;

said outer end face includes said first recess for receiving a body of a key and a second pin receiving recess located in said first recess offset from a longitudinal axis of the said plug;

said elongate rod being threaded along at least a portion at opposing ends thereof for threading into said threaded bore in said solid body and for threading into a threaded bore of said muzzle plug for connecting said solid body to said muzzle plugs and said key having an end portion projecting therefrom sized and shaped for close mating fit relation in said first recess and a second projection defining a pin for mating with said second pin receiving recess.

* * * * *